US006776215B2

(12) United States Patent
Schwellenbach et al.

(10) Patent No.: US 6,776,215 B2
(45) Date of Patent: Aug. 17, 2004

(54) DEVICE FOR CONTINUOUSLY CASTING METAL, PARTICULARLY STEEL

(75) Inventors: Joachim Schwellenbach, Düsseldorf (DE); Michael Vonderbank, Xanten (DE); Fritz-Peter Pleschiutschnigg, Duisburg (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/276,937

(22) PCT Filed: May 17, 2001

(86) PCT No.: PCT/EP01/05652

§ 371 (c)(1),
(2), (4) Date: Nov. 20, 2002

(87) PCT Pub. No.: WO01/89741

PCT Pub. Date: Nov. 29, 2001

(65) Prior Publication Data

US 2004/0099402 A1 May 27, 2004

(30) Foreign Application Priority Data

May 20, 2000 (DE) ..... 100 25 026
May 11, 2001 (DE) ..... 101 23 053

(51) Int. Cl.[7] ..... B22D 11/055; B22D 27/02

(52) U.S. Cl. ..... 164/418; 164/148.1; 164/443

(58) Field of Search ..... 164/418, 459, 164/466, 468, 502, 504, 443, 148.1

(56) References Cited

U.S. PATENT DOCUMENTS

| | | | | |
|---|---|---|---|---|
| 3,654,989 A | | 4/1972 | Meier et al. | |
| 3,933,193 A | | 1/1976 | Baker et al. | |
| 4,030,537 A | * | 6/1977 | Ward | 164/433 |
| 4,091,862 A | | 5/1978 | Lehmann et al. | |
| 5,871,040 A | * | 2/1999 | Kaseda et al. | 164/476 |
| 5,967,223 A | | 10/1999 | Kagan et al. | |

* cited by examiner

*Primary Examiner*—Kuang Y. Lin
(74) *Attorney, Agent, or Firm*—Sidley Austin Brown & Wood, LLP

(57) ABSTRACT

For a further development a device for continuous casting of metal, in particular steel, with a metal mold with mold walls (1,18) and a mold cooling device and which can remove high thermal flows and can be subjected to thermal loads and, thereble, is suitable for use at high speeds, at least one mold wall (1,18) of the mold of this device should include a steel wall (2) and a support mesh (3) for this wall and the device further should be provided with magnetic field generator (3.2) for generating a magnetic field (3.1) acting on the mold steel wall (2) via the support mesh (3) for attracting the mold steel wall (2) to the support mesh (3), with the mold cooling device comprising spray cooling means.

18 Claims, 3 Drawing Sheets

DEVICE FOR CONTINUOUSLY CASTING METAL, PARTICULARLY STEEL

BACKGROUND OF THE INVENTION

1. Field of the Invention

The invention relates to a device for continuous casting of metal, in particular steel, and including a metal mold with mold walls and a mold cooling device. Such a device serves for casting strands of different sizes, e.g., slabs, thin slabs, blooms, or beam blanks (dog bones). Here, the mold itself or the strand can oscillate, as during horizontal continuous casting. The mold itself, however, is arranged at a predetermined location and, therefore, can be called a continuous casting mold.

2. Description of the Prior Art

Such a mold, as a casting mold for continuous casting plants, consists either of mold plates, namely, of two plates for the mold broad sides and two plates for the mold narrow sides, or of mold tubes.

Such mold plates or mold tubes are formed of copper and have, as a rule, a thickness from 10 to 50 mm between the water cooling side and a side adjacent to the steel melt.

The selection of the copper plate thickness depends on the thermal load or the thermal flow measured in $MWh/m^2$ or $MW/m^2$. Thus, continuous casting plants with a mold for slab sizes with a thickness greater than 150 mm and width 3 m, with a casting speed of maximum about 2.5 m/min, have a thermal flow of maximum 2 $MW/m^2$. The thickness of the copper plates of the mold lies between 25 and 50 mm. In comparison, the thin slabs, which are cast with a casting speed up to 10 and in the future up to 15 m/min, have a thermal flow of maximum 4–5 $MW/m^2$ and copper plate thicknesses from 10 to 25 mm.

In order to match the increased thermal flow with the increased casting speed, the copper wall must always be thinner with the intensification of water cooling. This is difficult because a thinner mold wall always withstands worse high water pressures of 5–15 bar, which are necessary for a corresponding water velocity of 5–15 m/sec, without being deformed. An additional drawback consists in that the thin copper plates lose their rigidity when the recrystallization temperature exceeds its threshold at a too high thermal load of the cold-rolled copper. Besides, there is a problem of mounting of very thin copper plates on the mold frame. Usually, the mold plates are secured on a water box or a mold frame with bolts which are secured into the plates with their threaded section. This is not possible with very thin plates; in this case, the bolts must be welded to the copper plates.

An object of the invention is to so improve the devices of the above-described type so that the above-mentioned drawbacks are eliminated despite the increase of the casting speeds. In particular, a device for continuous casting with a mold should be provided which is capable of leading away of high thermal flows and can, therefore, be subjected to high thermal loads. Also the assembly should be improved.

SUMMARY OF THE INVENTION

This object is achieved by a device with the features of claim 1. Advantageous further developments are described in the sub-claims.

According to the invention, it is proposed that at least one mold wall includes a steel wall and a support mesh for the steel wall, that a magnetic field generator for generating a magnetic field is provided, which acts on the steel wall via the support mesh, and that the mold cooling device includes a spray cooling device.

The foregoing features permit to provide a mold having a thin mold wall with a high and controllable heat dissipation characteristics even at high casting speeds. The mold wall is formed, on one hand, of a steel wall facing the metal melt and, on the other hand, of a support mesh for stabilizing the steel wall. Because of magnetic attraction forces, the steel mold wall can be easily mounted. In addition, such a mold has a particular advantage consisting in that the steel mold wall, which is wearable because of its exposure to the metal melt, if needed, can be, contrary to an expensive copper wall, rapidly and simply replaced without a high-quality treatment, while the used one is "thrown away", i.e., is subject to a steel-recycling process. With the contemplated double wall, which consists of a thin steel wall and a support mesh, a simple and relatively inexpensive mold spray cooling can be used. In order to avoid high mold cooling water pressures, e.g., of 15–20 bar, the spray cooling takes place in open chambers or passages left by the support mesh, i.e., the thin steel wall is directly cooled, while being provided, despite this, with a relatively high support. With the spray cooling, the use of splash water becomes possible. Overall, along with a high efficiency of heat dissipation, a simple mold construction and, therefore, a relatively inexpensive mold is obtained. The inventive solution provides a mold that has a thermal conduction which otherwise would have required a copper plate thickness of 10 mm or more, and that can be easily mounted on a base frame, while permitting water cooling and being, at the same time, very economical.

The steel mold wall according to the present invention has preferably a thickness between 0.5 and 5 mm and corresponds, in its effectiveness, to a copper plate having a thickness of 10 mm, while having a definite constructional and economical advantage.

Preferably, the support mesh has a support wall with chambers formed therein, so that separate chambers or passages of the mesh are surrounded by wall webs of the support wall, with the magnetic field being introduced in the mold wall via the support wall.

The spray-cooling for cooling the mold wall includes, preferably, spray nozzles extending in the chambers of the support mesh at a side of the support mesh remote from the steel wall, i.e., through the freely accessible chamber regions or openings in the mesh. These spray nozzles for mold spray-cooling and the conduits for the cooling medium, in particular water, are integrated, completely or partially, in the support walls of the support mesh.

The advantage of the proposed spray cooling consists in that the intensity of the spray cooling is functionally adjusted in accordance with energy flow in the mold wall over the mold height. The energy flow has a thermal maximum somewhat in the upper third of the mold. With the spray cooling with separate, arranged one above the other, nozzles, the intensity of cooling can be adjusted in a controlled manner and, thereby, to be adapted to an energy flow with energy maximum or to an energy unit, as it is in this point a more intensive cooling takes place.

According to a further development of the device, it is contemplated to provide a device for controlling the surface temperature of the side of the steel mold wall adjacent to the liquid metal in order, when necessary, to adapt the spray cooling, by using a regulating mechanism, to fluctuation of the surface temperatures.

In addition to the proposed, according to the invention, attachment of the steel mold plate to the support mesh, the mold plate can be additionally secured mechanically. To this end, it is proposed to use a fixation device for securing the steel mold wall, e.g., a broad side in the middle of the broad side with respect to the mold height. In addition, the steel mold wall can be horizontally secured at the mold inlet or mold outlet. In addition to the broad sides, if necessary, the narrow sides can be secured in case they are likewise stabilized by a support mesh.

According to a particularly advantageous embodiment, the support walls of the support mesh are provided, at their ends facing the steel mold wall, i.e., in their fore-side or their head with a ball that serves as a (ball) bearing for a free, heat-dependent, movement of the steel mold plate. In order to form a fluid bearing, the balls are filled with fluid medium, e.g., water or gas. To this end, conduits are formed in the support walls which extend transverse to the steel mold wall and which supply the balls or the ball cages with water at the end sides of the support walls.

In order to prevent an uncontrolled flow of the spray water away after it has been sprayed on the free rear wall regions of the steel mold wall, according to the further development of the present invention, the support mesh includes an outer frame with a sealing surrounding the mesh.

Backward, i.e., toward the side remote from the steel melt, the used cooling medium can either flow freely away, i.e., flow to the atmosphere, or flow directly along. In the second case, preferably, a collection chamber is provided at the lower portion of the mold wall which opens into a drain for bringing the cooling water, if necessary, to a processing plant. In the collection chamber, the cooling medium, which flows along the support mesh wall, in particular along a wall portion of the support mesh located below a respective spray nozzle, is collected and is evacuated through the drain.

Further features and advantages of the invention follow from the sub-claims and from the following description that explains in detail embodiments of the invention shown in the drawings which include the above-described combination of features, separate features alone, or other essential combinations. The drawings show:

DETAILED DESCRIPTION OF THE PREFERRED EMBODIMENTS

Figure 1B:
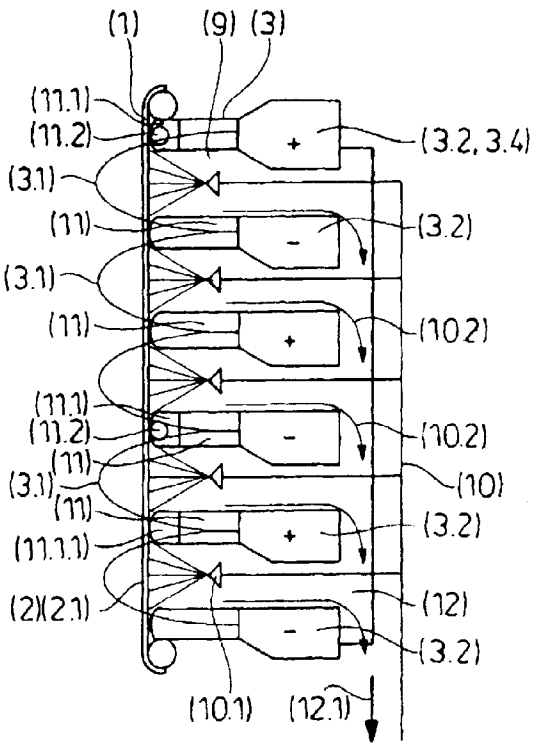
FIG. 1*b* a transverse elevational view of the mold wall of FIG. 1*a;*

FIG. 1 shows a broad side 1 of a mold having two broad and two narrow sides and suitable for casting a rectangular stock such as slabs or thin slabs. The mold broad side is formed by a steel mold wall 2 having a thickness of 2 mm. The steel mold wall 2 is a portion of an entire mold wall and is pulled toward a support mesh 3 by a magnetic field 3.1 which is generated by a magnetic field generator 3.2 and which acts on the steel mold wall 2 via the support mesh 3 having support walls 11. The steel mold wall 2 is formed preferably as a layered steel mold wall 2.1 which consists of layers steel/copper or copper/steel/copper or other metals instead of copper. The magnetic field generator can be formed preferably as a permanent magnet 3.4.

The steel mold wall 2 having a thickness of 2 mm has a specific thermal conductivity corresponding to a copper wall having a thickness 14 mm. For additional fixation, a device 4.1 (shown schematically) is provided and which secures the broad side with a width 17 and a height 16 along a transverse center line 4, whereby the thermal expansion can take place symmetrically in both horizontal directions (shown with arrows and reference characters 5).

Further, the steel mold plate is likewise secured at its upper edge 6 or a lower edge 7 of the mold in order to be able to uniformly expand in the vertical direction (shown with an arrow and a reference character 6). In the shown embodiment, one deals with a bar-shaped element rotatable about its longitudinal axis.

Figure 1A:
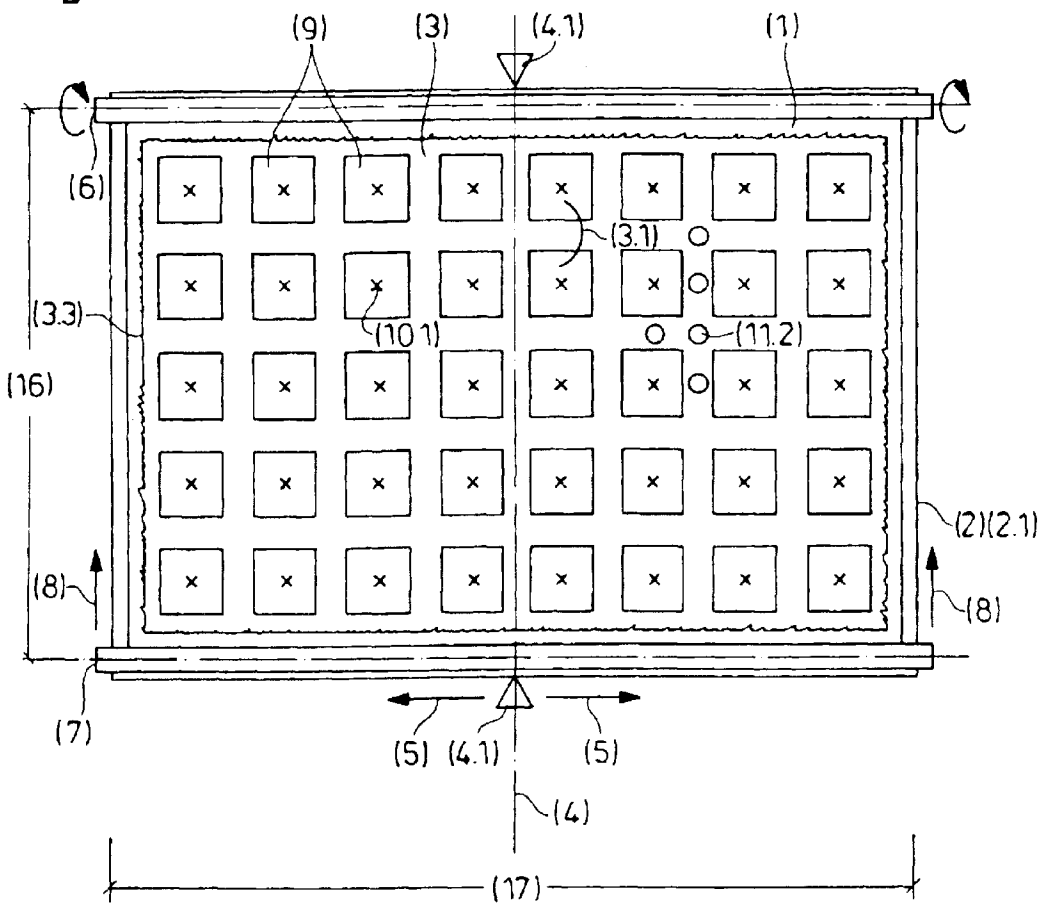
FIG. 1*a* a side view of a mold wall of a mold, here, a broad side of a mold for casting rectangular strands viewed from the side of steel melt.

In order to avoid high mold cooling water pressures of up to 15 or 20 bar, the back side of the steel mold wall 2 is cooled, as shown in Fig. 1*b*, with a mold spray-cooling device 10 with spray nozzles extending into chambers 9 of the support mesh 3, or the openings, or the passages. The heated cooling water or the falling splash water 10.2 can flow away along the support mesh wall 11 or support wall webs. The splash water can be collected in a closed space or a collection chamber 12 and be evacuated through a drain 12.1 or be evacuated into open atmosphere 13 (see FIG. 3*a*).

The outer frame of the rectangular magnetic support mesh 3.1 is surrounded with a rubber seal 3.3 to prevent an uncontrolled evacuation of the mold splash water 10.

The support wall 11 of the support mesh 3 is provided in the fore-regions 11.1 with balls 11.2 that serve as standard bearings or fluid bearings for a free, thermally-dependent, movement of the mold steel wall 2. Examples of support points or the balls 11.2 can be seen in FIG. 1*a*. Instead of balls, the support mesh heads 11.1 can be formed of rounded graphite heads 11.1 which should provide for a thermally-dependent sliding movement.

Figure 3B:
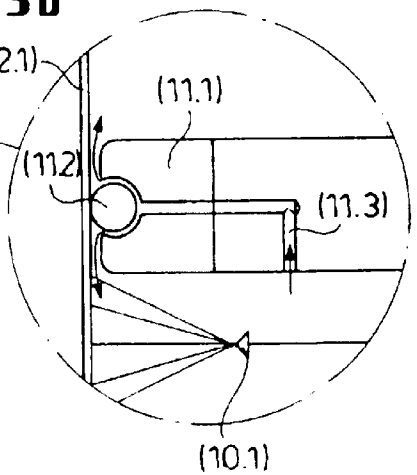
FIG. 3*b* a detail with a ball bearing in the fore-side end of the support wall for supporting the steel mold wall on the support mesh.

A detailed view of an embodiment of a ball support is shown is FIG. 3*b*. It shows a section of a support wall 11 with the support wall head 11.1 with the ball 11.2 received in the head for supporting the steel mold wall 2 or 2.1. The ball cage is supplied with fluid 11.3, such as water or gas, through a conduit, and which serves for forming a fluid bearing or a hydraulic bearing. Also shown are spray nozzles 10.1 provided between the support walls 11 or the webs of the mesh 3.

Figure 2B:
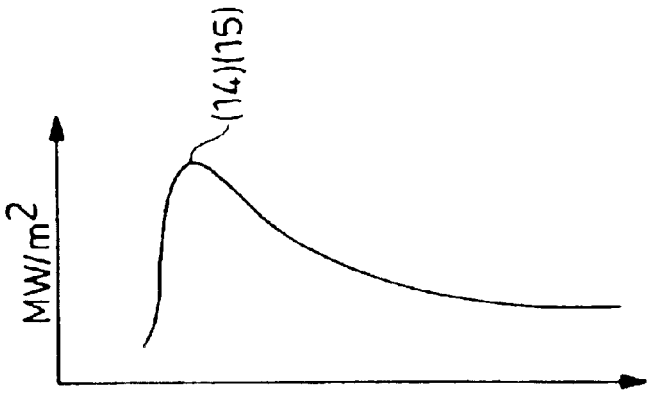
FIG. 2*b* a diagram showing a thermal flow profile over the mold height.
Figure 2A:
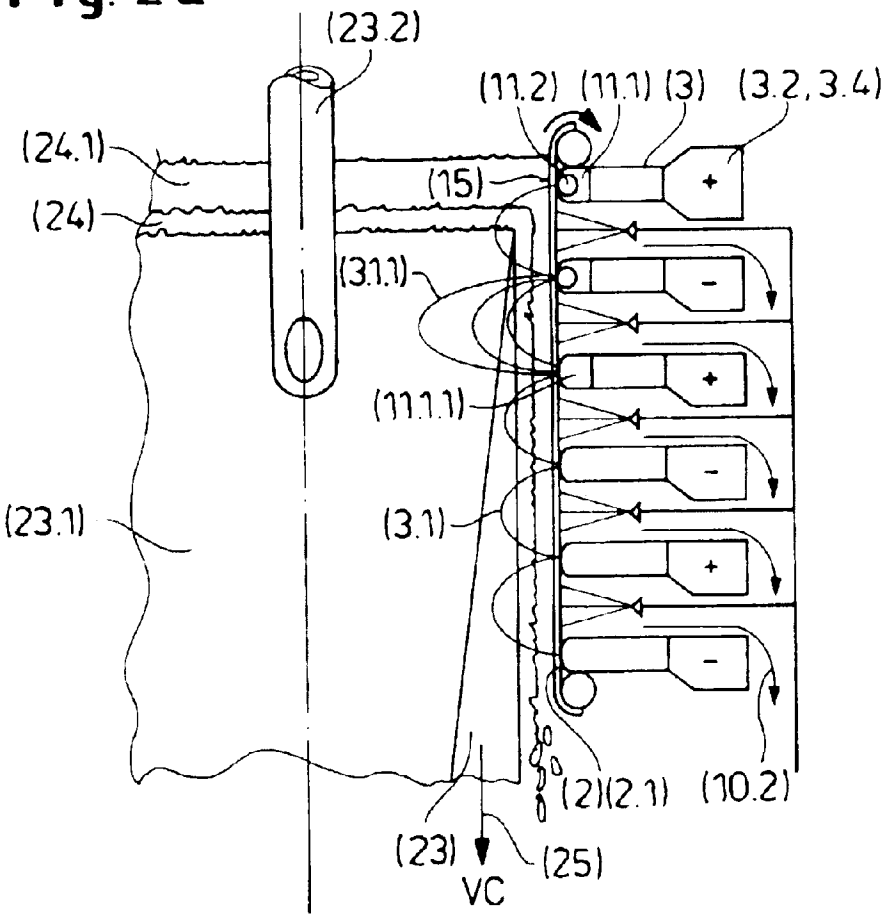
FIG. 2*a* a transverse elevational view of a mold wall with spray cooling adapted to the energy flow distribution over the mold height.

FIG. 2*a* shows the use of the inventive device for continuous casting or a mold with a submerged nozzle 23.2 that projects into the mold. The reference character 24 designates a casting slag, and the reference character 24.1 designates powder. The liquid steel 23.1 is provided into the mold through the submerged nozzle 23.2, and solidification starts, with formation of a strand skin 23 on the mold walls. The casting speed Vc is shown with a reference character 25. The magnetic field 3.1, which is generated by a magnetic field generator 3.2 or 3.4, can be so formed that it would influence the steel flow in the mold as an electromagnetic brake 3.1.1.

In FIG. 2*a*, the reference character 15 represents the mold wall temperature of the mold side adjacent to the liquid steel. For measurement of the temperature, a corresponding measuring or control device is provided. FIG. 2*a* also shows the embodiments of the support with balls 11.2 integrated with the head of the support wall 3 or with a rounded head, preferably, of graphite 11.1.1. Preferably, only one type of support is used, however, it is within the scope of the invention to provide the support wall with both types of the support. In the mold with the spray cooling shown in FIG. 2, the back-flowing splash water 10.2 does not hang as a screen but rather flows often downward, whereby it hangs then beneath the mold.

An advantageous feature of the invention consists in that the spray cooling or the parameters of separate spray nozzles are adapted to a respective required cooling of the mold. Contrary to FIG. 2*a*, FIG. 2*b* shows occurring energy values 14 over the mold height, i.e., a maximum released heat in the upper third of the mold. For controlling the mold wall, temperature 15 is measured, and the spray cooling is correspondingly adapted over the mold height.

Figure 3A:
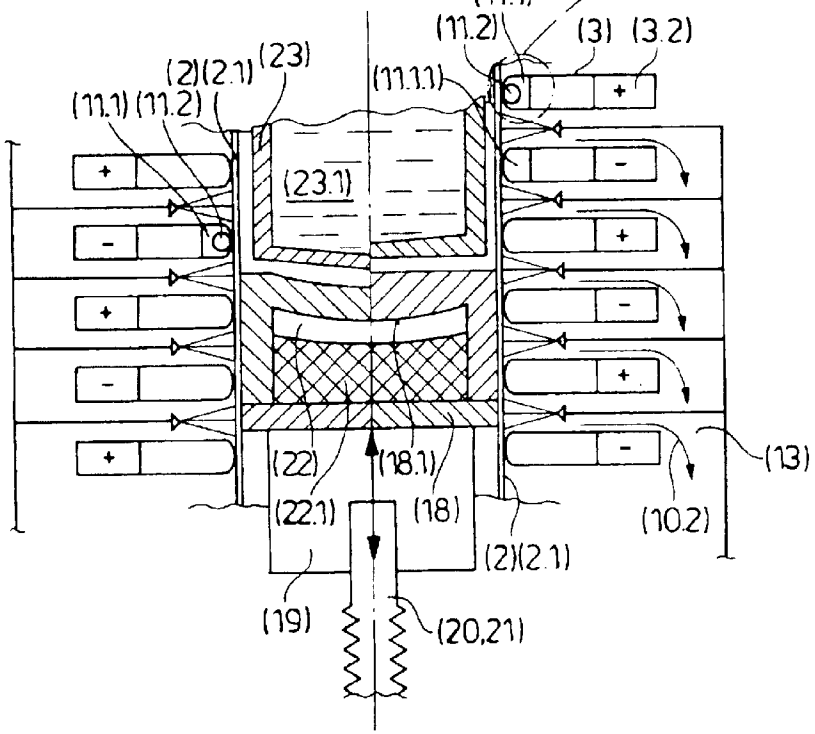
FIG. 3*a* a cross-sectional view of a mold with a narrow side wall and with a small side section with a width and conicity change.

FIG. 3*a* shows a narrow side 18 of a mold. In this embodiment of the mold, the broad sides are formed according to the invention, whereas the narrow sides are formed of steel but without any support mesh. However, it is within the scope of the invention to form both the broad sides and the narrow sides or only the narrower sides according to the invention. In the embodiment shown, the narrow side is formed of steel. The narrow side has a high stability due to a slight concavity and/or inner convexity 18.1. It is mounted on its own narrow side body 19 which provides for width adjustment 20 and conicity adjustment 21 of the mold. This construction allows a water pressure of up to 20 bar in the region of a conventional small side water cooling, here shown with a reference character 22. A reference character 22.1 designates a water-displacement body. In another embodiment, the small sides of a mold can consist of water-cooled copper plates according to the state of the art. The components, which have been discussed with reference to other embodiments, have in FIG. 3*a* the same reference characters.

Returning to the proposed, according to the invention, wall construction of a casting mold for continuous casting and the corresponding cooling, the chambers 9 or openings of the support mesh 3 can have any arbitrary shape, with a rectangular shape being shown. Preferably, the chambers 9 have a honeycomb shape, with the chambers 9 or 12 extending between the support walls 11.

Altogether, there is provided a mold for a continuous casting that provides for a high regulation of thermal conductivity and a simple assembly, in particular, for assembly of a steel mold wall. The control of the mold temperature can be effected in both casting (vertical) direction and in the transverse to the casting direction (horizontal) direction. The steel mold wall can be a disposable wall, which makes a high quality an expensive maintenance, which is necessitated by wear, superfluous. A relatively simple mold spray cooling can be used that can be adjusted functionally with respect to its effect or intensity. A conventional spraying water can be used. The mold has a simple construction and is relatively inexpensive.

Reference Numerals

1. Broad side of a slab mold
2. Steel mold wall, e.g., the broad side of a slab
21 Layered steel mold wall, e.g., of steel/Cu, Cu/Steel/Cu, or Me/Steel/Me
3 Support mesh, grid
3.1 Magnetic field
3.1.1 Electromagnetic brake for killing the steel flow in the mold, EMBR
3.2 Magnetic field generator
3.3 Sealing, e.g., a rubber sealing
3.4 Permanent magnet
4 Transverse Central line of broad side
4.1 Device for securing the steel mold wall (2)
5 Horizontal direction
6 Upper mold edge, mold inlet
7 Lower mold edge, mold outlet
9 Vertical direction, casting direction of a slab plant
10 Mold spray cooling
10.1 Spray nozzles, nozzle head
10.2 Return flow of splash water
11 Support wall of the support mesh (3) with chambers (4)
11.1 Head of the support wall
11.1.1 Graphite head of the support wall
11.2 Balls which serve as bearings for free, thermally caused movement of the steel mold wall (2)
11.3 Fluid such as, e.g., gas or water that serves for flowing a fluid bearing or hydro-bearing
12 Closed space, chamber of the mold spray cooling means (10)
12.1 Splash water removal
13 Open atmosphere of the mold spray cooling means
14 Energy value
15 Mold wall temperature on a side adjacent to liquid steel
16 Mold Height
17 Mold width
18 Narrow side
18.1 Concave and/or convex shape of the heat-removing narrow side
19 Narrow side body
20 Width adjustment
21 Conicity adjustment
22 Conventional narrow side mold water cooling with water pressure maximum 20 bar
22.1 Water displacement body
23 Strand skin
23.1 Liquid steel
24 Casting slag
24.1 Casting powder
25 Casting speed, Vc
26 Honeycomb shape of the support mesh.

What is claimed is:

1. A device for continuous casting of steel, comprising:

a mold having mold walls (1, 18) at least one of which includes a mold steel wall (2) and a support mesh (3) for the mold steel wall (2);

a magnetic field generator (3.2) for generating a magnetic field (3.1) which acts on the mold steel wall (2) via the support mesh so that the mold steel wall (2) is attracted to the support mesh (3); and a mold cooling device including spray cooling means (10).

2. A device according to claim 1, wherein the mold steel wall (2) has a thickness between 0.5 and 5 mm.

3. A device according to claim 1, wherein the mold steel wall (2.1) consists of a steel layer and a copper layer.

4. A device according to claim 1, wherein the mold steel wall (2.1) consists of metal/steel/metal layers.

5. A device according to claim 4, wherein the metal layers are copper layers.

6. A device according to claim 1, wherein the support mesh (3) includes a support wall (11) with chambers (9) formed therein, and wherein the magnetic field (3.1) is transmitted into the mold steel wall via the support wall (11).

7. A device according to claim 6, wherein the spray cooling means (10) includes spray nozzles (10.1) extending into the chambers (9) of the support mesh (3) for cooling the mold steel wall (2) from the rear.

8. A device according to claim 1, wherein the mold has a mold inlet (6) and a mold outlet (7), and the mold steel wall (2) is secured horizontally at the mold inlet (6) or the mold outlet (7).

9. A device according to claim 1, wherein the support mesh (3) has a support wall (11) provided, at its ends adjacent to the mold steel wall (2), with balls (11.2) which support the mold steel wall (2) for thermally induced movement.

10. A device according to claim 9, wherein the balls (11.2) are filled with a fluid medium.

11. A device according to claim 1, wherein the support mesh (3) has a support wall (11) having at its ends facing the mold steel wall (2), a graphite (11. 1.1) rounded support mesh head.

12. A device according to claim 1, wherein the support mesh (3) includes an outer frame surrounding the support mesh, and the outer frame has a sealing (3.3) for controlling return flow of mold spray cooling medium (10.2).

13. A device according to claim 1, further comprising a collection chamber (12) and a drain (12.1) for a directed removal of cooling medium (10.2) sprayed onto the mold steel wall (2), and wherein the cooling medium (10.2) that flows back over a support wall (11) of the support mesh (3), is collected in the collection chamber (12) and is removed one of through the drain (12.1) and into open atmosphere.

14. A device according to claim 1, wherein narrow sides (18) of mold forming walls include a steel wall having an inner convexity (18.1) for a mechanical stabilization.

15. A device according to claim 1, wherein narrow sides of mold forming walls are formed of copper plates.

16. A device according to claim 6, wherein the spray nozzles (10.1) of the mold spray cooling means and feed conduits for the cooling medium (11.3) are integrated one of partially and completely in support walls (11) of the support mesh (3).

17. A device according to claim 6, wherein the chambers (9) of the support mesh (3) have a honeycomb shape.

18. A device according to claim 1, wherein the magnetic field generator (3.2) is formed as a permanent magnet (3.4).

* * * * *